US008946580B2

(12) United States Patent
Hoffmann et al.

(10) Patent No.: US 8,946,580 B2
(45) Date of Patent: Feb. 3, 2015

(54) CONTACT BRIDGE WITH BLOW MAGNETS

(75) Inventors: Ralf Hoffmann, Berlin (DE); Matthias Kroeker, Mittenwalde-Garow (DE)

(73) Assignee: Tyco Electronics AMP GmbH, Bensheim (DE)

( * ) Notice: Subject to any disclaimer, the term of this patent is extended or adjusted under 35 U.S.C. 154(b) by 700 days.

(21) Appl. No.: 13/139,208

(22) PCT Filed: Dec. 4, 2009

(86) PCT No.: PCT/EP2009/066459

§ 371 (c)(1),
(2), (4) Date: Jun. 10, 2011

(87) PCT Pub. No.: WO2010/066651

PCT Pub. Date: Jun. 17, 2010

(65) Prior Publication Data

US 2011/0240603 A1 Oct. 6, 2011

(30) Foreign Application Priority Data

Dec. 12, 2008 (EP) ..... 08021662

(51) Int. Cl.

| | |
|---|---|
| ***H01H 1/54*** | (2006.01) |
| ***H01H 9/44*** | (2006.01) |
| *H01H 1/20* | (2006.01) |
| *H01H 50/54* | (2006.01) |

(52) U.S. Cl.

CPC ..... *H01H 1/54* (2013.01); *H01H 9/443* (2013.01); *H01H 1/20* (2013.01); *H01H 50/546* (2013.01); *H01H 2001/545* (2013.01)

USPC ..... 218/26; 218/23

(58) Field of Classification Search

USPC ..... 218/21–26, 30, 31, 146, 148–154; 335/16, 147, 201, 202

See application file for complete search history.

(56) References Cited

U.S. PATENT DOCUMENTS

| | | | | |
|---|---|---|---|---|
| 4,513,270 | A | 4/1985 | Belbel et al. | |
| 5,546,061 | A | 8/1996 | Okabayashi | |
| 5,815,058 | A * | 9/1998 | Gizaw | 218/22 |
| 2005/0285704 | A1 | 12/2005 | Imanishi | |

FOREIGN PATENT DOCUMENTS

| | | | |
|---|---|---|---|
| EP | 0080939 | A | 6/1983 |

OTHER PUBLICATIONS

International Preliminary Report on Patentability, dated Jun. 14, 2011, issued by The International Bureau of WIPO, Geneva, Switzerland, for PCT/EP2009/066459; 6 pages.

International Search Report and Written Opinion issued by the European Patent Office, dated Feb. 11, 2010, for PCT/EP2009/066459; 9 pages.

* cited by examiner

*Primary Examiner* — Amy Cohen Johnson
*Assistant Examiner* — Marina Fishman
(74) *Attorney, Agent, or Firm* — Faegre Baker Daniels LLP

(57) ABSTRACT

The present invention relates to contactors for unidirectional DC operation with permanent magnetic arc extinguishing. In addition to the blow magnets, the contactors are equipped with compensatory permanent magnets for compensating the magnetic field in the vicinity of the contact bridge in order to prevent contact levitation, i.e., an uncontrolled opening of the contacts that is due to a magnetic force generated by a strong current flowing through the contact bridge. To this end, the compensatory permanent magnets are arranged in the vicinity of the contact bridge and polarized in the opposite direction of the blow magnets. The magnetic field of the compensatory magnets and the current flowing through the contact bridge are generating a magnetic force that acts on the contact bridge and tends to keep the electrical contacts closed.

12 Claims, 3 Drawing Sheets

CONTACT BRIDGE WITH BLOW MAGNETS

The present invention relates to contactors with blowout magnets for arc extinguishing.

BACKGROUND OF THE INVENTION

Several techniques are known in the art for extinguishing arcs that are formed between a fixed contact and a movable contact during the switching operation of a contactor, including magnetic blowout. For magnetic blowout, a coil or a permanent magnet is arrange in the vicinity of the contacts such that the direction of the magnetic field is perpendicular to the arc. The magnetic field will the exert a Lorentz force on the arc by means of which the arc is driven in a desired direction, for example into an arc chamber, where the arc is brought into contact with splitter plates for cooling and extinguishing.

From reference DE 1 246 851, for instance, a direct current switching apparatus is known, wherein two oppositely directed permanent magnets are arranged in the vicinity of each of the two contacts of a contact bridge in order to blowout, depending on the direction of the current flow, at least one of the two arcs.

A similar configuration is also known from US patent application US 2008/0030289. According to this reference, a contactor with a contact bridge and two oppositely directed permanent magnets, arranged in the vicinity of the two contact points, is provided. Depending on the direction of the current flow through the switch, either one of the two arcs is blown into an arc extinguishing chamber, where it will be quickly eliminated.

The problem with conventional contactors having permanent magnets for magnetic blowout, however, is that it can hardly be avoided that the blowout field is also affecting the contact bridge on which the movable contacts are mounted. Hence, the magnetic field will also exert a Lorentz force on the contact bridge. If the blowout magnets are arranged such that the arcs are pushed out of the switch, as required for arc extinguishing, this force will also tend to push the contact bridge in the very same direction. In a worst case scenario with very high currents (typically larger than 1 kA) over closed contacts, this force may overcome the contact holding force, resulting in an uncontrolled opening of the contacts. The arc generated in such a situation will rapidly produce an enormous amount of heat, leading to complete destruction of the contactor.

From U.S. Pat. No. 5,815,058 a high current switch is known that is equipped with a contact enhancement apparatus for preventing the contact from being opened by repulsive magnetic forces generated by a large current flowing through the switch in a fault situation. According to this reference, the contact bridge of the switch is provided with an iron bar in order to generate an attractive electromagnetic force to another iron bar located beneath the contact bridge. This attractive electromagnetic force will counteract the repulsive force so as to ensure that the contact remains close, even when a large current is flowing through the switch. This switch, however, is not equipped with an arc extinguishing means.

SUMMARY OF THE INVENTION

It is thus an aim of the present invention to provide a contactor with blowout magnets and a high current carrying capacity. It is a further aim of the present invention to provide a contactor with blowout magnets, wherein any uncontrolled opening of the contact can be avoided.

This is achieved by the features as set forth in the independent claim. Preferred embodiments are the subject matter of dependent claims.

It is the particular approach of the present invention to arrange, in the vicinity of the contact bridge, an additional permanent magnet that is polarized in the opposite direction of the blowout magnets.

According to the present invention, a contactor is provided that comprises a contact bridge with a first and a second contact arranged at respective ends of the contact bridge, a first and a second permanent magnet arranged in the vicinity of the first and the second contact, respectively, the first and the second permanent magnets being polarized in the same direction such that an arc generated at the first or the second contact is blown in a direction away from the contact bridge, and a third permanent magnet arranged in the vicinity of the contact bridge and between the first and the second permanent magnets, the third permanent magnet being polarized in a direction opposite to the first and the second permanent magnets.

Preferably, the third permanent magnet is adapted for compensating the magnetic field generated by the first and the second permanent magnets at a central portion of the contact bridge. In this manner, the magnetic blow field is restricted to the area where the arcs occur and does not affect the contact bridge. This reduces the risk of an uncontrolled opening of the contacts.

More preferably, the third permanent magnet is also adapted for compensating the magnetic field generated by a current flowing through the first and the second contact at a central portion of the contact bridge. In this case, the overall magnetic field at a central portion of the contact bridge is substantially zero. Hence, the problem of contact levitation is solved without increasing the mechanical force required for moving the contact bridge to an opened position. Moreover, the current carrying capacity of the contactor can be improved without any modifications to its electromechanical actuator needed.

According to another preferred embodiment, the third permanent magnet is adapted for over-compensating the magnetic field generated by the first and the second permanent magnets and the magnetic field generated by a current, in particular the maximum rated current of the contactor, flowing through the first and the second contact at a central portion of the contact bridge. In this case, the third permanent magnet is generating, in combination with the current flowing through the contact bridge, an overall magnetic force that acts on the contact bridge and tends to keep the contact bridge with respect to the first and the second contact in a closed position.

The maximum rated current of the contactor is preferably within the range of 100 A to 10 kA, especially in the order of 1 kA. Currents in this order of magnitude typically occur in the context of hybrid cars, electrically powered cars, and other high-current applications.

According to a preferred embodiment, at least one of size, strength and arrangement of the third permanent magnet is adapted in order to achieve a desired ratio of a magnetic force that tends to keep the contact bridge in a closed position and a magnetic force acting on the arc. Size, especially the width along the direction of the contact bridge, and arrangement, especially placement relative to the contact bridge, can be readily controlled in order to reach the design goal regarding the strength ratio of the magnetic forces involved.

Preferably, the contactor further comprises pole plates for maximizing the magnetic field of the third permanent magnet at a central portion of the contact bridge. Pole plates may also be used for optimizing the distribution of the magnetic field in the vicinity of the contact bridge and the contacts. Specifically, pole plates may be arranged such that the magnetic blow field is maximum at the contacts, whereas the oppositely directed compensatory field of the third magnet is maximum at and restricted to the central portion of the contact bridge.

According to a preferred embodiment, the third permanent magnet consists of a pair of two permanent magnets, which are polarized in a direction opposite to the first and the second permanent magnets and arranged at two facing sides of the contact bridge. In this manner, a particularly strong and homogeneous magnetic field may be created that is concentrated at the central portion of the contact bridge.

The above and other objects and features of the present invention will become more apparent from the following description and preferred embodiments given in conjunction with the accompanying drawings, in which.

DETAILED DESCRIPTION

Figure 1B:
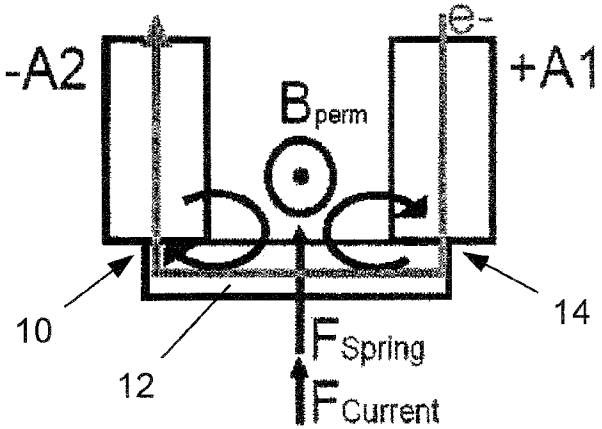
FIG. 1B is a schematic drawing similar to that of FIG. 1A but with reversed current.
Figure 1A:
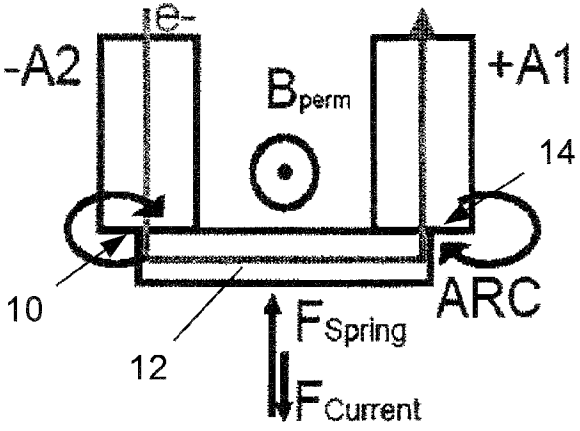
FIG. 1A is a schematic drawing illustrating the effect of the magnetic blowout field on the arcs and the contact bridge.

FIGS. 1A and 1B are schematic drawings illustrating the effect of the magnetic blowout field on the arcs and the contact bridge in a conventional contactor comprising a contact bridge (12) for making and breaking an electrical contact between two terminals +A1 and −A2, and permanent magnets (not shown) for generating a magnetic field $B_{perm}$, that is perpendicular to the drawing plane.

In FIG. 1A, a DC current is flowing from terminal −A2 to terminal +A1. In a closed position of the contactor, an electromagnetic actuator (not shown) is applying a mechanical force $F_{spring}$ on the contact bridge (12) in order to keep the electrical contacts closed. As soon as the contact bridge starts moving to an opened position, arcs will form at the two contacts (10,14) of the bridge. In the figure, the current flow through the arc at the left contact (10) is downwards, whereas the current flow through the arc at the right contact (14) is upwards. Hence, current flow and magnetic field are perpendicular to each other, resulting in a force that is directed to the left at the left contact (10) and to the right at the right contact (14) such that both arcs are pushed away from the contact bridge, out of the contact area. The arcs may thus be rapidly extinguished, for instance due to their lengthening alone or by bringing them into contact with splitter plates (not shown) or other arc extinguishing means.

As it is also apparent from FIG. 1A, the current flow through the contact bridge is also perpendicular to the magnetic field $B_{perm}$, resulting in an electromagnetic force $F_{current}$ acting on the contact bridge. In accordance with known laws of electrodynamics, this force is directed downwards, namely in a direction opposite to the mechanical holding force $F_{spring}$. Depending on the strength of the current and the magnetic field, the electromagnetic force may compensate and overcome the mechanical holding force $F_{spring}$, leading to an uncontrolled opening op the electrical contact. This effect, which is also known as contact levitation, imposes a severe upper limit to the current carrying capacity of the contactor.

Figure 2B:
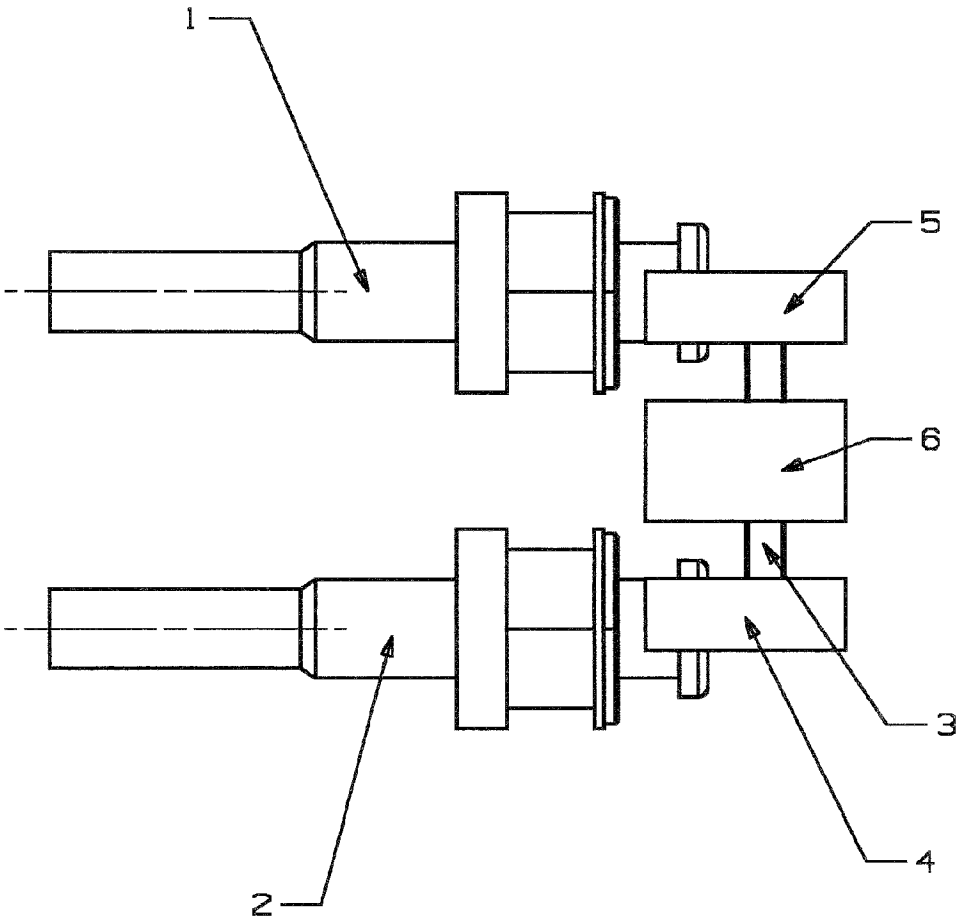
FIG. 2B is a side view of the arrangement of the permanent magnets in the contact area of a contactor according to a preferred embodiment of the present invention.
Figure 2A:
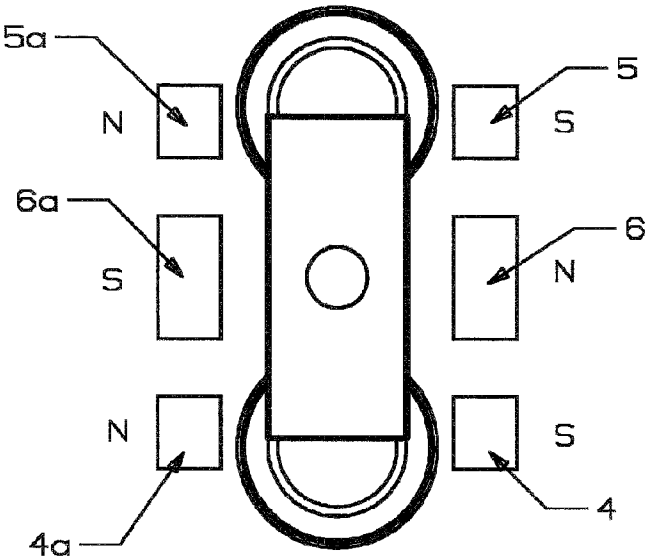
FIG. 2A is a top view of the arrangement of the permanent magnets in the contact area of a contactor according to a preferred embodiment of the present invention.

The effect of contact levitation is further aggravated by the intrinsic magnetic field of the contactor itself, namely by the field generated by the current flowing through the contactor. Specifically, current flowing through conductor segments that are oriented perpendicular to the contact bridge generate a magnetic field that adds to the magnetic field $B_{perm}$ generated by the blow magnets. In FIG. 2A, for instance, the current flowing in a vertical direction through the terminals −A2 and +A1 generate a circular field that adds positively to the magnetic field at the contact bridge. Hence, even without permanent blow magnets, a current flowing through the contactor generates a force that tends to open the contact bridge. As an aside it is noted that this finding is also in accordance with Lenz's Rule.

Following the laws of electrodynamics, the direction of the electromagnetic force $F_{current}$ is reversed if the direction of the current flow is reversed. This situation is illustrated in FIG. 1B, wherein a DC current is flowing from terminal +A1 to terminal −A2. The reversed current results in an upward force $F_{current}$ that adds to the mechanical holding force $F_{spring}$. Although this resolves the problem of contact levitation, the increased holding force may also be undesirable when the electrical contact is to be opened again.

Far worse, however, is the effect that reversing the current flow will render arc extinguishing non-functional, because the direction of the forces acting on the arcs is also reversed. Therefore, the arcs are no longer pushed away from the contact bridge but are drawn into the bridge arrangement. Due to the non-extinguishing of the arcs, the contactor will be destroyed sooner or later. The contactor of FIG. 1 is thus for unidirectional DC operation only and the problem of contact levitation cannot be solved by reversing the direction of current flow.

According to the present invention, the problem of contact levitation is solved by suppressing the magnetic field in the area of the contact bridge. To this end, at least one additional permanent magnet is provided in the vicinity of a central portion of the contact bridge. The additional permanent magnets are polarized in a direction opposite to the blow magnets. Due to the linear superposition of magnetic fields, the effective strength of the magnetic field at a central position of the contact bridge will be at least reduced as compared to the conventional contactor. Depending on the actual field distribution along the contact bridge, the resulting electromagnetic force on the contact bridge will be reduced accordingly.

Due to the orientation of the additional permanent magnets, the intrinsic magnetic field of the bridge arrangement is compensated as well. Hence, even in the absence of blow magnets, an uncontrolled opening of the electrical contact is prevented by an electromagnetic force that is generated by the additional permanent magnets and the current flowing through the contact bridge. This force acts on the contact bridge and tends to keep it in its closed position.

Arguing in terms of forces rather than fields, it is also noted that the additional permanent magnets generate, in combination with the current flowing through the contact bridge, a force that tends to keep the contact bridge in a closed position. The overall force acting on the contact bridge is the sum of all forces involved, namely the electromagnetic force generated by the blow magnets, the electromagnetic force generated by the intrinsic magnetic field, the electromagnetic force generated by the additional permanent magnets, and the mechanical force generated by the actuator. According to the present invention, the additional permanent magnets are provided in order to keep the overall force within desired limiting values, and in particular to avoid any uncontrolled opening of the contacts.

The strength and distribution of the magnetic field generated by the additional permanent magnets may be adapted to specific requirements. For instance, the strength of this magnetic field may be required to be high enough to prevent uncontrolled opening of the contact even in a short circuit condition (currents in the order of 10 kA) whereas controlled opening and closing of the contact during regular operation (currents in the order of 1 kA) should not be affected. This may be achieved by adapting the arrangement and size of the additional permanent magnets, as well as by choosing the appropriate material of the additional permanent magnets, in particular with respect to their coercive force.

Further, since both the force on the arcs and the force that tends to keep the contact bridge in a closed position depend on the current flowing through the contactor, the strength and arrangement of the additional permanent magnets may be adapted so as to achieve a desired ratio of these two forces.

Figure 3B:
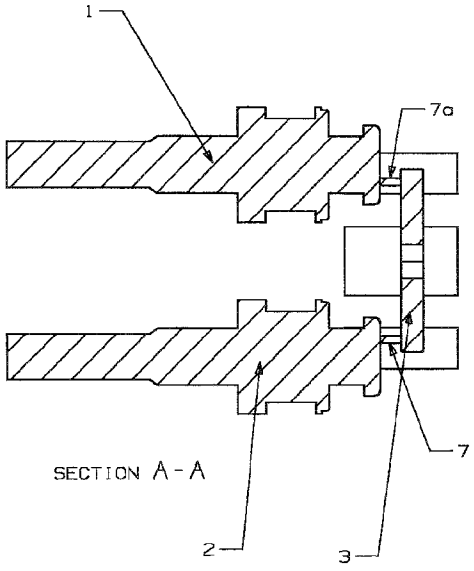
FIG. 3B is a sectional view along section A-A in FIG. 3A.
Figure 3A:
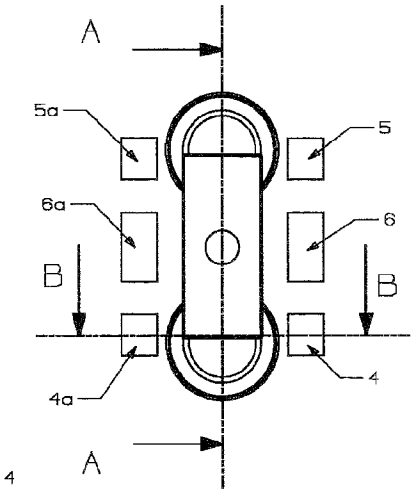
FIG. 3A is a top view of the arrangement of the permanent magnets in the contact area of a contactor according to a preferred embodiment of the present invention.
Figure 3C:
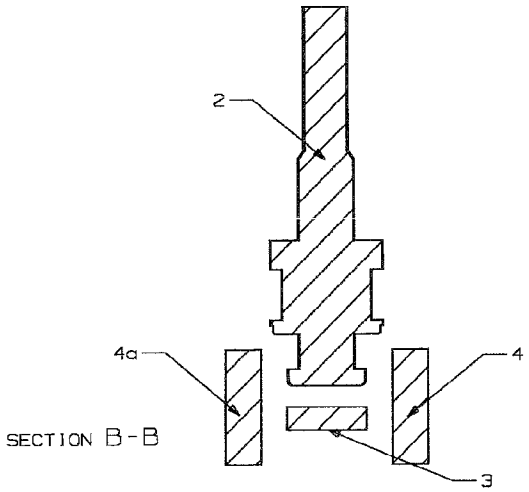
FIG. 3C is a sectional view along section B-B in FIG. 3A.

FIGS. 2A to 3C illustrate an exemplary configuration of the contact area of a contactor in accordance with a preferred embodiment of the present invention. FIGS. 2A and 2B show a top view and a side elevation of the contact area, respectively. Further, FIGS. 3B and 3C show a sectional view of the contact area along sections A-A and B-B indicated in FIG. 3A. Throughout these drawings, like elements are denoted by like reference numerals.

A movable contact bridge (3) is arranged for making and breaking an electrical contact between two terminals (1, 2). To this end, each end of the contact bridge engages with a respective one of two fixed contacts. Two sets of blow magnets (4, 4*a*, 5, 5*a*) are provided in the vicinity of the two contacts in order to extinguish arcs (7, 7*a*) that form at these contacts upon breaking the current. Each of these sets consist of two permanent magnets that are polarized in the same direction in order to generate a homogeneous field in between, as indicated letters N and S in FIG. 2A.

In accordance with the present invention, an additional set of permanent magnets (6, 6*a*) is provided in the vicinity of a central portion of the contact bridge, namely between the blow magnets (4, 4*a*, 5, 5*a*), in order to suppress the magnetic field at the contact bridge. In a manner similar to the blow magnets, the additional set of permanent magnets consists of two permanent magnets that are polarized in the same direction, but oppositely to the blow magnets, in order to generate a homogeneous compensatory field inbetween.

It should be noted that the number of magnets and their arrangement in pairs of two is by way of example only and that the present invention is not limited to the configuration shown in FIGS. 2 and 3. In fact, similar advantages can be achieved by any number of permanent magnets as long as the magnets arranged close to a central portion of the contact bridge are oppositely polarized as the magnets arranged close to the switching contacts at the end portions of the contact bridge.

In addition, pole plates may be provided for optimizing the magnetic field strength and its distribution throughout the contact bridge arrangement. Pole plates may for instance be arranged for each pair of magnets shown in FIGS. 2 and 3 so as to establish a return flux path for maximizing the magnetic field.

According to the present invention, contact levitation can reliably be prevented without any modifications to the actuating mechanism of the contactor. The present invention thus provides a simple and cost effective solution to the problem of contact levitation. Moreover, the present invention demonstrates how the current carrying capacity of a conventional contactor can be increased with only a minor modification to its design.

Summarizing, the present invention relates to contactors for unidirectional DC operation with permanent magnetic arc extinguishing. In addition to the blow magnets, the contactors are equipped with compensatory permanent magnets for compensating the magnetic field in the vicinity of the contact bridge in order to prevent contact levitation, i.e., an uncontrolled opening of the contacts that is due to a magnetic force generated by a strong current flowing through the contact bridge. To this end, the compensatory permanent magnets are arranged in the vicinity of the contact bridge and polarized in the opposite direction of the blow magnets. The magnetic field of the compensatory magnets and the current flowing through the contact bridge are generating a magnetic force that acts on the contact bridge and tends to keep the electrical contacts closed.

The invention claimed is:

1. A contactor comprising a contact bridge;

a first and a second contact arranged at respective ends of the contact bridge;

a first and a second permanent magnet arranged in the vicinity of the first and the second contact respectively, the first and the second permanent magnets being polarized in the same direction such that an arc generated at the first or the second contact is blown in a direction away from the contact bridge; and a third permanent magnet arranged in the vicinity of the contact bridge and between the first and the second permanent magnets, the third permanent magnet being arranged vertically in line with the first and the second permanent magnets, the third permanent magnet being polarized in a direction opposite to the first and the second permanent magnets, the first, second, and third permanent magnets are positioned to a first lateral side of the contact bridge.

2. The contactor according to claim 1, wherein the third permanent magnet is adapted for compensating the magnetic field generated by the first and the second permanent magnets at a central portion of the contact bridge.

3. The contactor according to claim 1, wherein the third permanent magnet is adapted for compensating the magnetic field generated by a current flowing through the first and the second contact at a central portion of the contact bridge.

4. The contactor according to claim 1, wherein the third permanent magnet is adapted for over-compensating the magnetic field generated by the first and the second permanent magnets and the magnetic field generated by a current flowing through the first and the second contact at a central portion of the contact bridge.

5. The contactor according to claim 1, wherein the third permanent magnet is adapted for generating, in combination with a current flowing through the contact bridge, an overall magnetic force that acts on the contact bridge and tends to keep the contact bridge with respect to the first and the second contact in a closed position.

6. The contactor according to claim 3, wherein the current flowing through the contact bridge and through the first and the second contact is a maximum rated current of the contactor.

7. The contactor according to claim 6, wherein the maximum rated current of the contactor is within the range of 100 A to 10 kA, preferably in the order of 1 kA.

8. The contactor according to claim 1, wherein at least one of size, strength and arrangement of the third permanent magnet is adapted in order to achieve a desired ratio of a magnetic force that tends to keep the contact bridge in a closed position and a magnetic force acting on the arc.

9. The contactor according to claim 1, further comprising pole plates for maximizing the magnetic field of the third permanent magnet at a central portion of the contact bridge.

10. The contactor according to claim 1, wherein the third permanent magnet comprises a pair of two permanent magnets, which are polarized in a direction opposite to the first and the second permanent magnets and arranged at two facing sides of the contact bridge.

11. The contactor according to claim 1, wherein the third permanent magnet is spaced apart from the contact bridge.

12. The contactor according to claim 1, wherein the third permanent magnet is positioned completely to the first lateral side of the contact bridge and spaced apart from the first contact of the contact bridge and the second contact of the contact bridge.

* * * * *